US007004378B1

(12) United States Patent
Tharpe, Jr.

(10) Patent No.: US 7,004,378 B1
(45) Date of Patent: Feb. 28, 2006

(54) SMALL-ARTICLE CONTAINER

(75) Inventor: John M. Tharpe, Jr., Panama City, FL (US)

(73) Assignee: R & L Engineering, Inc., Albany, GA (US)

( * ) Notice: Subject to any disclaimer, the term of this patent is extended or adjusted under 35 U.S.C. 154(b) by 0 days.

(21) Appl. No.: 10/309,974

(22) Filed: Dec. 4, 2002

(51) Int. Cl.
*B65D 5/00* (2006.01)

(52) U.S. Cl. ..... 229/120; 229/143; 229/174; 229/178

(58) Field of Classification Search ..... 229/120, 229/143, 150, 174, 177, 178
See application file for complete search history.

(56) References Cited

U.S. PATENT DOCUMENTS

| | | | | | |
|---|---|---|---|---|---|
| 728,404 | A | * | 5/1903 | McGehee et al. | 229/120 |
| 1,195,274 | A | * | 8/1916 | Schiek | 229/104 |
| 3,040,954 | A | * | 6/1962 | Salmon | 229/108 |
| 3,114,493 | A | * | 12/1963 | Dunkin | 206/511 |
| 3,706,410 | A | | 12/1972 | Baker | |
| 3,730,418 | A | | 5/1973 | Spencer | |
| 4,082,215 | A | * | 4/1978 | Eichenauer | 229/120 |
| 4,142,665 | A | * | 3/1979 | Jewell et al. | 229/132 |
| 4,513,907 | A | | 4/1985 | Grosshuesch | |
| 4,537,344 | A | * | 8/1985 | Thomas | 229/169 |
| 4,911,355 | A | * | 3/1990 | Bannister | 229/143 |
| 5,181,651 | A | | 1/1993 | Oppenheim | |
| 5,312,034 | A | | 5/1994 | Nakagawa et al. | |
| 5,458,899 | A | * | 10/1995 | Floyd et al. | 426/404 |
| 5,690,275 | A | | 11/1997 | Bose et al. | |
| 5,704,193 | A | | 1/1998 | Roe et al. | |
| 5,772,107 | A | | 6/1998 | Younger | |
| D399,739 | S | | 10/1998 | Sheffer | |
| D399,740 | S | | 10/1998 | Sheffer | |
| D399,741 | S | | 10/1998 | Sheffer | |
| 6,029,886 | A | | 2/2000 | Sheffer | |

* cited by examiner

*Primary Examiner*—Tri M. Mai
(74) *Attorney, Agent, or Firm*—Baker, Donelson, Bearman, Caldwell & Berkowitz

(57) ABSTRACT

A container that holds small bulk articles observable through mesh-covered openings while restricting access for substituting articles among containers formed by folding a blank on scores to define a top wall with two opposing end walls and two opposing side walls. Each side wall has a bottom wall foldable on a respective score for closing the container after filing with contents. At least one of the top wall and side walls defines an opening that is covered with a netting that restricts casual removal of the contents while permitting visual inspection.

20 Claims, 4 Drawing Sheets

SMALL-ARTICLE CONTAINER

TECHNICAL FIELD

The present invention relates to containers for holding and storing small bulk articles. More particularly, the present invention relates to containers that allow consumers to visually inspect small bulk articles held within the container while restricting transfer of articles between containers and method of filing containers with small bulk articles.

BACKGROUND OF THE INVENTION

Small single-use bulk articles, such as fruits and vegetables, are packed in a variety of containers for shipping and sale. These containers include corrugated paperboard boxes and bags. Often the containers are especially configured to suit the particular shape of the small bulk article. For example, a corrugated paperboard container includes liners having dished recesses that receives and holds avocados. Some types of articles, such as oranges and related fruits, are often grouped into large-volume containers and sold as a group rather than individually. A variety of types of bags have been used for this purpose, including plastic film bags with a number of small openings spaced widely apart for communication of air and mesh bags made of plastic filaments or fiber materials. The bags allow the contents to be inspected prior to purchase. However, bags lack sturdy side walls which make bags difficult to transport. Typically a group of the bags are placed in a larger container, such as a wood-cleat crates or corrugated paperboard containers. The containers are opened at the point of sale for customers to inspect the goods and select a bag to purchase.

Small corrugated containers have been provided in the past for storing shipping and displaying citrus and other fruit, vegetable, and other small article bulk products. These corrugated containers have openings that allow air communication between the interior of the container and atmosphere. In some instances, the containers are "open" top and stack together to "close" the container below in the stack. The upper container is closed by a covering sheet. At retail the upper container in the stack is open for inspection and selection of the contents. The empty container is removed to open the next container. While those types of containers are useful for products purchased in single quantities, volume-packed products typically are placed in a closed container for selection of the group rather than individual articles.

A recently provided container combines the rigid side walls of a corrugated container with a mesh-covered opening in the top, whereby the contents can be at least partially observed by the customer prior to purchase. The corrugated container provides a sturdy bottom, side walls, and top portion for stacking the containers for shipping from packers to wholesalers and retail outlets. The open-top container is first filled with the articles to be shipped and displayed, and the top portion folded to partially close the container. Second, header sheets attach to the lengthwise ends of the netting member and adhesively fix to the outside faces of the opposing side walls. The container accordingly provides a viewing window in the top so that consumers may inspect the contents of the container prior to purchase. The netting member facilitates communication of air between the contents and atmosphere while providing a netting or mesh sheet to retain the articles within the container.

While containers such as this have met with success in packaging citrus for shipping to wholesale and retail markets, there are drawbacks to its use. The assembly and packing process requires filling the container and then further manipulating the container to secure the opposing header sheets to the netting member and to the side walls of the container. This container however leaves the opposing sides of the netting loose relative to opposing end portions of the top. Unfortunately, this enables consumers to remove single articles for exchanging articles among containers.

Accordingly, there is a need in the art for an improved small bulk articles container that facilitates inspection of the articles by consumers while restricting substitution of articles among containers and a method of filing such container with the articles. It is to such that the present invention is directed.

BRIEF SUMMARY OF THE INVENTION

The present invention solves the above-described problems in the prior art by providing a container that holds and stores small bulk articles, comprising a blank of a sheet material scored to define a top, two opposing end walls, and two opposing side walls. The blank folds on the scores to form an inverted container with an open bottom. The opposing side walls each have a bottom wall foldable on a respective score for closing the container after filling with contents. At least one of the top, the side walls, or the end walls defines an opening. A netting member attaches to an inner surface in overlying relation to the opening. The contents within the closed container are visible through the netting member but the netting member restricts casual removal of the contents.

In another aspect, the present invention provides a method of making a container for shipping and displaying small bulk articles, comprising the steps of:

(a) attaching a netting member in overlying relation to an opening formed at least in one of a top wall, a pair of opposing end walls, or a pair of opposing side walls, defined in a blank foldable on scores to form container body;

(b) forming the container body having the top wall, two opposing end walls, and two opposing side walls folded substantially normal on the scores;

(c) filling the container body through an open bottom with the articles to be shipped and displayed therein; and (d) closing the container body by folding bottom walls on respective scores in the side walls;

whereby the contents within the closed container are visible through the netting member while the netting member restricts casual removal of the contents therefrom.

In another aspect, the present invention provides a method of filling a closable container with a plurality of articles, comprising the steps of:

(a) forming a container from a foldable sheet having scores to define a top, a pair of opposing side walls, a pair of opposing end walls, and a bottom, the container disposed top-down on a conveyor for passing the container with the bottom open past a filler;

(b) communicating a plurality of articles from the filler into the container through the open bottom; and (c) closing the bottom to complete a closed container.

Objects, advantages and features of the present invention will become apparent from a reading of the following detailed description of the invention and claims in view of the appended drawings.

DETAILED DESCRIPTION OF THE ILLUSTRATED EMBODIMENTS

Figure 1:
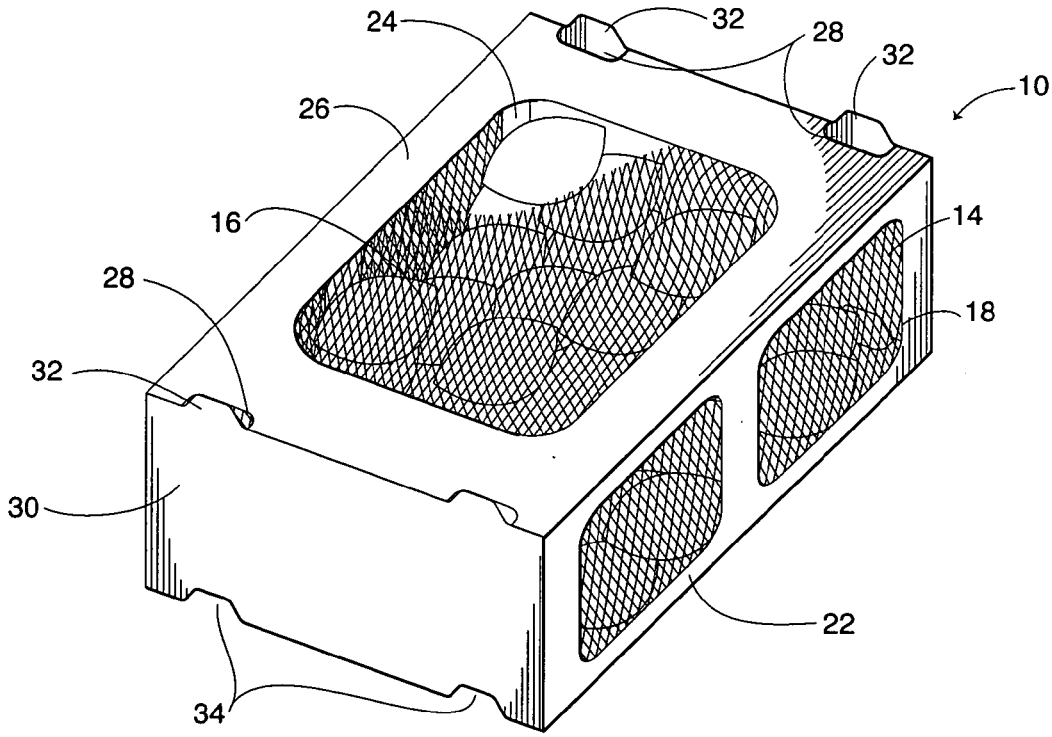
FIG. 1 is a perspective view of container according to the present invention closed and inverted to a shipping and storing position for holding small articles therein.

Referring now in more detail to the drawings, in which like numerals indicate like parts throughout the several views, FIG. 1 illustrates a container 10 of the present invention that holds small bulk articles such as citrus 12 for shipping from a packer to retailer for display and sale. Sheets of mesh or netting members generally 14, 16 covers openings 18, 20 defined in opposing side walls 22, 24 and a top 26. The netting members 14, 16 allow the citrus 12 to be observed in the container while restricting casual access to the contents of the container. In an alternate embodiment, the openings are formed in at least one of the top 26 and the side walls 22,24. The top 26 defines two pairs of opposing recesses 28 in opposing ends of the top. The container 12 has opposing outside end walls 30. Each of the outside end walls 30 defines a pair of tabs 32 and opposing recesses 34 aligned with the tabs, for a purpose discussed below.

Figure 2:
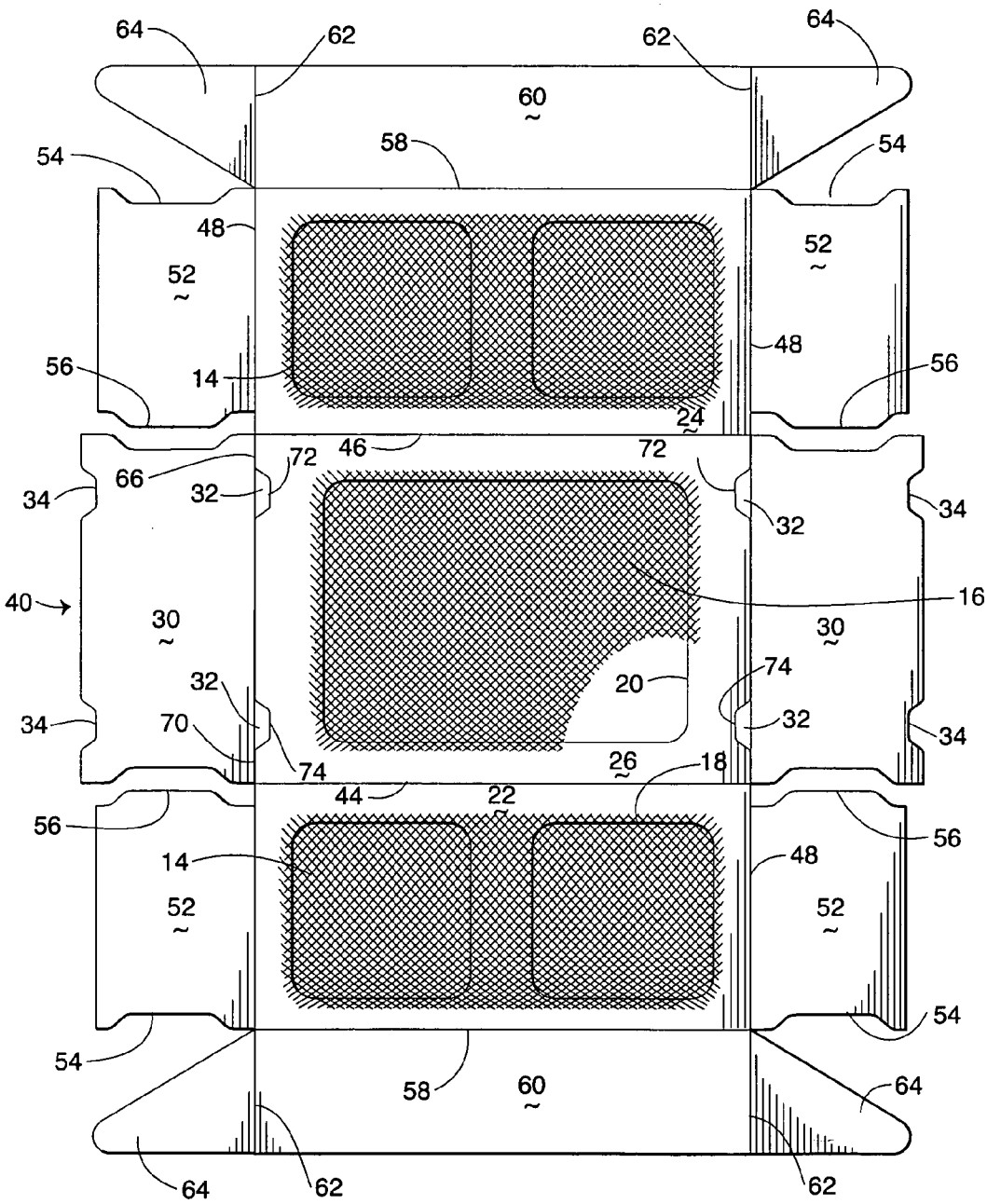
FIG. 2 is a plan view of a foldable sheet for forming the container illustrated in FIG. 1.

FIG. 2 illustrates in plan view a blank 40 of a sheet material foldable on scores for forming walls of the container 10. In the illustrated embodiment, the blank 40 is corrugated paperboard. The blank 40 is symmetrical relative to a longitudinal axis 41 and a transverse axis 43 of the top wall 26. The top 26 defines the opening 20 that is covered by the netting 16 during formation of the container 10 as discussed below. Opposing scores 44 define the two opposing side walls 22. The side walls 22 fold in a first direction to an assembled position perpendicular to the top 26, as discussed below. The side walls 22 in the illustrated embodiment each define a pair of openings 18 that are covered by the netting 14 during formation of the container 10. Opposing scores 48 in the side walls 22 define opposing inside end walls 52. The inside end walls 52 fold on the scores 48 towards a respective end wall on the opposing side wall to close the ends of the container 12. Each inside end wall 52 defines a recess 54 and an opposing tab 56. An outward score 58 in the side walls 22 defines a bottom flap 60. The bottom flaps 60 fold parallel to the top 26 to close the container 10, as discussed below. In the illustrated embodiment, opposing scores 62 in the bottom flaps 60 define a pair of locking tabs 64 that fold inwardly of the inside end wall 52 to secure the bottom flaps 60 closed. In an alternate embodiment, the bottom flaps are simply folded over and secured with an adhesive tape or other securing media.

In the illustrated embodiment, the top 26 further defines a series of spaced-apart scores 66, 68, 70 at the lateral extent of the top wall. The scores 66, 68,70 define gaps 71, 73. The scores 66, 68, 70 define the outside end walls 30 in the blank 40. A pair of slots 72, 74 cut through the blank 40 are spaced from a line defined by the scores 66, 68, 70 and aligned to the gaps 71, 73 between the scores. The opposing distal ends of the slots 72, 74 taper arcuately towards the scores 66, 68 and 68, 70. The slots 72, 74 cooperate with the scores 66, 68, 70 to define the tabs 32. The slots 72, 74 allow the tabs 32 in the outside ends 30 to extend from the blank 40 when the outside end walls fold to an extended position during folding assembly of the container 10. The recesses 34 in the outside end walls 30 align with the tabs 32.

Figure 3:
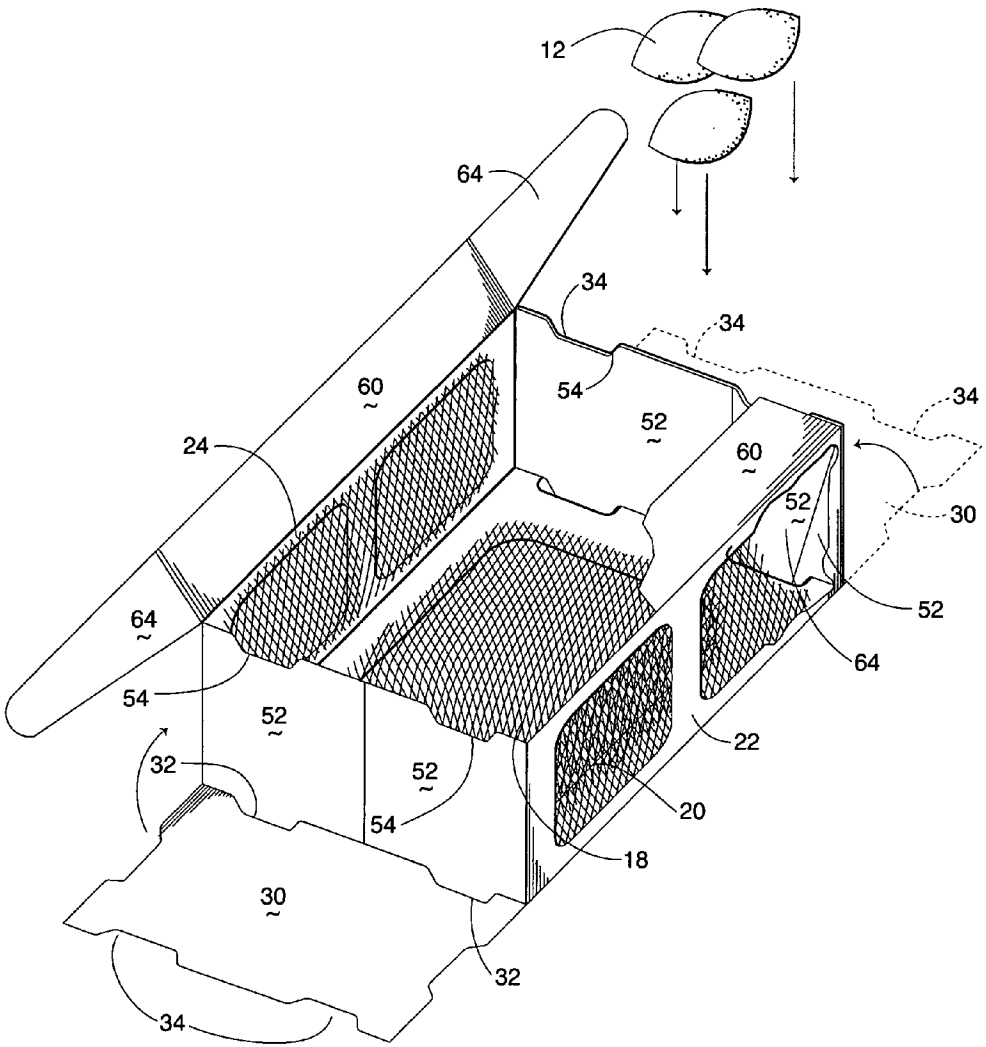
FIG. 3 is a perspective view of the container partially assembled by folding the scored sheet illustrated in FIG. 2 with a bottom being open to illustrate a method of filling the container according to the present invention.

FIG. 3 is a perspective view of the container 10 partially assembled by folding the blank 40 on the scores discussed above to extend the side walls and end walls perpendicular to the top for holding the plurality of bulk articles or other contents, such as the illustrated citrus 12.

The netting 14, 16 attaches to the blank 40 in overlying relation to the openings 18, 20. With reference to FIG. 2, perimeter portions of the openings 18, 20 receive adhesive. The netting 14, 16 overlies the openings 18, 20 and is secured to the blank 40 by the adhesive. In an alternate embodiment (not illustrated), a header sheet of corrugated paperboard attaches to the netting members, for example about a perimeter of the netting members. The netting members 14, 16 then are positioned in overlying relation to the openings 18, 20. The headers may be secured with adhesive or a mechanical interlock. For example, the header boards may be positioned between and secured by the overlapping inside end walls 52 and the outside end walls 30.

With reference to FIGS. 2 and 3, the container 10 forms by folding the opposing side walls 22 on the respective scores 44, 46 to the extended or erect assembled position substantially normal or perpendicular to the top wall 26. The respective end walls 52 fold inwardly on the scores 48 towards the end wall on the opposing side wall 22. The outside end wall 30 folds on the scores 66, 68, 70 upwardly substantially normal to the top 26 against the outside faces of the end walls 52. As the outside end walls 30 fold upwardly, the tabs 32 detach from the scores 72, 74. The tabs 56 of the end walls 52 are received in the opening that results from the tab 32 separating from the slot 72, 74. This wedges the outside end wall 30 in position against the inside end walls 52. The partially assembled container 10 thereby defines an open bottom opposing the top 26. Citrus 12 are placed in the partially assembled container 10 through the open bottom. After filling, the bottom flaps 60 fold on the scores 58 parallel to the top 26 while the locking tabs 64 fold on the scores 62 inwardly of the inside end walls 52 to secure the bottom flaps closed.

Figure 4:
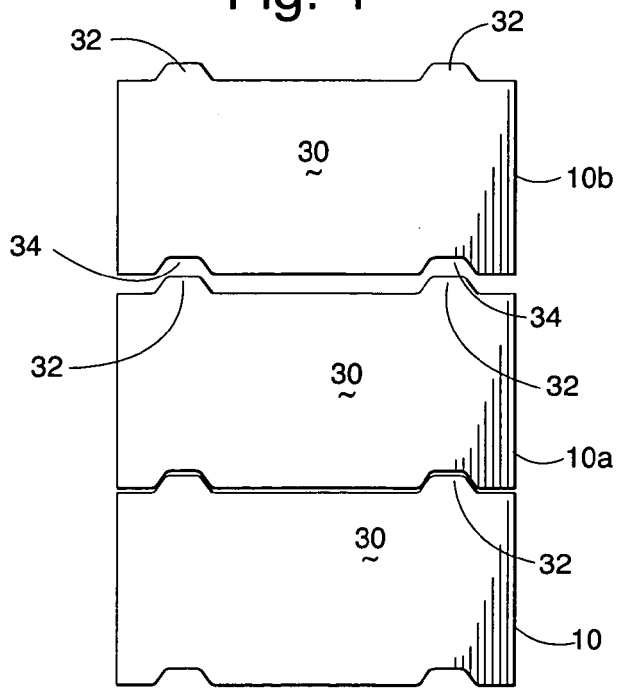
FIG. 4 is an end view of a stack of the containers illustrated in FIG. 1.

FIG. 4 illustrates a stack 80 of the containers 10 after filling with citrus or other contents. The containers 10 are filled and then inverted and placed in the stack. The tabs 32 of a lower one 10*a* of the containers 10 in the stack 80 nestingly receive the recesses 34 of an adjacent vertically higher container 10*b* in the stack. The tabs 32 and the recesses 34 interlock the containers 10 in the stack 80.

Figure 5:
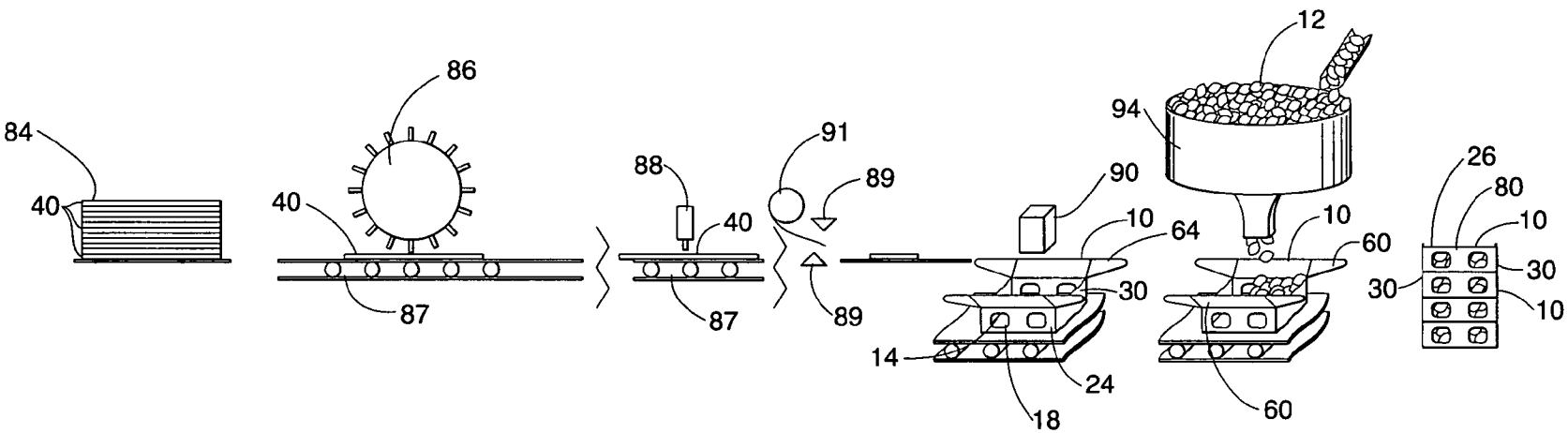
FIG. 5 is a schematic illustration of a packing line for filling the container illustrated in FIG. 1 in practicing the method according to the present invention.

FIG. 5 is a schematic illustration of a packing line 82 for receiving, assembling, and filling the container 10 in practicing a method of filling containers with contents according to the present invention. The packing line includes a supply 84 of the container blanks 40. A die 86 includes projecting members to define the openings and the scores in the blank 40 discussed above. The die operates conventionally to cut the openings and form the scores. The blank 40 is carried on a conveyor 87. An adhesive applicator 88 applies beads of adhesive onto portions of the blank 40 defining the perimeters of openings 18, 20. The adhesive applicator 88 mounts conventionally to movable shafts (not illustrated) for travel relative to the conveyor 87 in longitudinal and transverse directions. The netting members 14, 16 are cut with a knife 89 to length from a supply 91 and attach with the adhesive to overlie the openings 18, 20. A device 90 to form containers receives one of the container blanks 40 including the attached netting 14, 16, and forms the open-ended container illustrated in FIG. 3. Box-forming apparatus are known in the art for foldingly forming paperboard containers. A contents filling station 92 communicates citrus 12 (or other contents) from a supply 94 into the open-bottom, top-down container 10. After filling, the containers 10 are closed by folding the bottom flaps 60. The filled containers 10 are inverted and placed top-up in the stack 80.

With reference to FIG. 5, the present invention provides a method of packing a container with bulk articles or other contents, such as the citrus 12. The uncut blanks 40 transfer on a conveyor from the supply 84 past the die 86. The die 86 bears against the blank 40 and defines the openings and the scores as discussed above with respect to FIG. 2. The adhesive applicator 88 applies the beads of adhesive onto the blank 40 about the perimeter portions of the blank that define the openings 18, 20. The netting 14, 16 attaches with the adhesive in overlying relation to the openings 18, 20. The container forming device 90 receives one of the container blanks 40 that includes the attached netting 14, 16. With reference FIG. 3, the container former 90 folds the blank 40 on the scores to assemble the open-ended container. Contents communicate from the supply 92 at the filling station 92 into the open-ended container 10. After filling, the bottom flaps 60 fold parallel to the top 26 while the locking flaps fold and insert inwardly of the inside end walls 52. The filled container 10 is inverted and placed in the stack 80.

Thus, the present invention provides the improved container particularly suited for holding small bulk articles such as citrus and particularly facilitating visual inspection of the contents while restricting casual transfer of articles among containers and provides methods of packing small bulk articles in improved containers. This specification has described the illustrated embodiments of the present invention, including the steps necessary for fabricating and using the container of the disclosed embodiments. It is to be understood, however, that numerous changes and variations may be made in the construction of the present container within the spirit and scope of the present invention. It should therefore also be understood that the foregoing specification relates only to the illustrated embodiments of the present invention and that modifications and changes may be made therein without departing from the scope thereof as set forth in the appended claims.

What is claimed is:

1. A container for shipping and displaying small bulk articles, comprising:

a blank of a sheet material, scored to define a top wall, a pair of opposing end walls, and a pair of opposing side walls, foldable on the scores to form an inverted container with an open bottom, the opposing side walls each having a bottom wall foldable on a respective score for closing the container after filing with contents and a pair of inside end walls each foldably attached along a respective score at opposing longitudinal ends of the side wall, and opposing edges of the inside end walls define a recess and an opposing tab, whereby in a stack of said containers, the tab of a container is received in the recess of an adjacent vertically higher container;

at least one of the top wall, side walls, or end walls defining an opening; and a netting attached to an inner surface in overlying relation to the opening, whereby the contents within the closed container are visible through the netting but the netting restricts casual removal of the contents therefrom.

2. The container as recited in claim 1, wherein the bottom wall foldably attaches at an edge of the side walls outwardly of the top wall.

3. The container as recited in claim 2, wherein the bottom wall defines opposing locking tabs foldably attached along a score at longitudinal edges of the bottom wall, which locking tabs fold inwardly of the end walls upon folding the bottom wall parallel to the top wall.

4. The container as recited in claim 1, wherein the top wall defines two pairs of opposing slots spaced from the score defining the end wall, whereby folding the end walls on the scores defines tabs extending from the end walls adjacent the top wall.

5. The container as recited in claim 4, wherein the end walls further define recesses opposing the tabs for receiving the tabs of a vertically adjacent container when stacked.

6. The container as recited in claim 1, wherein the sheet comprises corrugated paperboard.

7. A container for shipping and displaying small bulk articles, comprising:

a blank of a corrugated paperboard sheet, scored to define a top wall, two opposing end walls, and two opposing side walls, foldable on the scores to form an inverted container with an open bottom, the opposing side walls each having a bottom wall foldable on a respective score outwardly of the top wall for closing the container after filing with contents;

the longitudinal ends of the side walls defined by scores that each define a foldably attached inside end wall that folds towards an opposing inside end wall on the opposing side wall, opposing edges of the inside end walls define a recess and an opposing tab, whereby in a stack of said containers, the tab of a container is received in the recess of a adjacent vertically higher container;

the top wall and two opposing side walls each defining an opening; and a netting attached to an inner surface in overlying relation to the openings, whereby the contents within the closed container are visible through the netting but the netting restricts casual removal of the contents therefrom, whereby a container forms by folding the side walls from the top wall, folding the inside end walls towards each other, and folding the end walls from the top wall for filling the container from the open bottom prior to folding the bottom walls parallel to the top wall.

8. The container as recited in claim 7, wherein the bottom wall defines opposing locking tabs foldably attached along a score at longitudinal edges of the bottom wall, which locking tabs fold inwardly of the end walls upon folding the bottom wall parallel to the top wall.

9. The container as recited in claim 7, wherein the top wall defines two pairs of opposing slots spaced from the score defining the end wall, whereby folding the end walls on the scores defines tabs extending from the end walls adjacent the top wall.

10. The container as recited in claim 9, wherein the end walls further define recesses opposing the tabs for receiving the tabs of a vertically adjacent container when stacked.

11. A container for shipping and displaying small bulk articles, comprising:

a blank of a sheet material, scored to define a top wall, a pair of opposing end walls, and a pair of opposing side walls, foldable on the scores to form an inverted container with an open bottom, the top wall defining two pairs of opposing slots spaced from the score defining the end wall whereby folding the end walls on the scores defines tabs extending from the end walls adjacent the top wall, the opposing side walls each having a bottom wall foldable on a respective score for closing the container after filing with contents;

at least one of the top wall, side walls, or end walls defining an opening; and a netting attached to an inner surface in overlying relation to the opening, whereby the contents within the closed container are visible through the netting but the netting restricts casual removal of the contents therefrom.

12. The container as recited in claim 11, wherein the end walls further define recesses opposing the tabs for receiving the tabs of a vertically adjacent container when stacked.

13. The container as recited in claim 11, wherein the bottom wall foldably attaches at an edge of the side walls outwardly of the top wall.

14. The container as recited in claim 13, wherein the bottom wall defines opposing locking tabs foldably attached along a score at longitudinal edges of the bottom wall, which locking tabs fold inwardly of the end walls upon folding the bottom wall parallel to the top wall.

15. The container as recited in claim 11, wherein the blank further defines an inside end wall foldably attached along a score at opposing longitudinal ends of the side walls.

16. The container as recited in claim 11, wherein opposing edges of the inside end walls define a recess and an opposing tab, whereby in a stack of said containers, the tab of a container is received in the recess of a adjacent vertically higher container.

17. The container as recited in claim 11, wherein the sheet comprises corrugated paperboard.

18. A container for shipping and displaying small bulk articles, comprising:

a blank of a corrugated paperboard sheet, scored to define a top wall, two opposing end walls, and two opposing side walls, foldable on the scores to form an inverted container with an open bottom, the top wall defines two pairs of opposing slots spaced from the score defining the end wall, whereby folding the end walls on the scores defines tabs extending from the end walls adjacent the top wall, the end walls further define recesses opposing the tabs for receiving the tabs of a vertically adjacent container when stacked, the opposing side walls each having a bottom wall foldable on a respective score outwardly of the top wall for closing the container after filing with contents, the longitudinal ends of the side walls defined by scores that each define a foldably attached inside end wall that folds towards an opposing inside end wall on the opposing side wall;

the top wall and two opposing side walls each defining an opening; and a netting attached to an inner surface in overlying relation to the openings, whereby the contents within the closed container are visible through the netting but the netting restricts casual removal of the contents therefrom, whereby a container forms by folding the side walls from the top wall, folding the inside end walls towards each other, and folding the end walls from the top wall for filling the container from the open bottom prior to folding the bottom walls parallel to the top wall.

19. The container as recited in claim 18, wherein opposing edges of the inside end walls define a recess and an opposing tab, whereby in a stack of said containers, the tab of a container is received in the recess of a adjacent vertically higher container.

20. The container as recited in claim 18, wherein the bottom wall defines opposing locking tabs foldably attached along a score at longitudinal edges of the bottom wall, which locking tabs fold inwardly of the end walls upon folding the bottom wall parallel to the top wall.

* * * * *